US006983490B1

(12) United States Patent
Lewis et al.

(10) Patent No.: US 6,983,490 B1
(45) Date of Patent: Jan. 10, 2006

(54) PROTECTIVE GARMENT COMPRISING OUTER SHELL, OUTER MOISTURE BARRIER, THERMAL LINER WITHIN OUTER MOISTURE BARRIER, AND INNER MOISTURE BARRIER AT DISTAL EDGES OR AT HEMS

(75) Inventors: Patricia Lewis, Tipp City, OH (US); William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/941,599

(22) Filed: Sep. 15, 2004

(51) Int. Cl.
*A62B 17/00* (2006.01)

(52) U.S. Cl. ..... 2/97; 2/458

(58) Field of Classification Search ..... 2/93, 2/458, 455, 456, 97, 87, 123, 81, 82, 85
See application file for complete search history.

(56) References Cited

U.S. PATENT DOCUMENTS

| | | | | |
|---|---|---|---|---|
| 4,114,200 | A * | 9/1978 | Smith et al. | 2/51 |
| 4,502,153 | A | 3/1985 | Lapedes et al. | |
| 5,388,270 | A * | 2/1995 | Hewitt | 2/93 |
| 5,890,226 | A * | 4/1999 | Snedeker et al. | 2/97 |
| 6,336,223 | B1 * | 1/2002 | Snedeker | 2/97 |
| 6,430,754 | B1 | 8/2002 | Taylor et al. | |

* cited by examiner

*Primary Examiner*—John J. Calvert
*Assistant Examiner*—Andrew W. Sutton
(74) *Attorney, Agent, or Firm*—Wood, Phillips, Katz, Clark & Mortimer

(57) ABSTRACT

In a protective garment comprising an outer shell, a liner providing a conventional moisture barrier within the outer shell, and a thermal liner within the liner providing the conventional moisture barrier, a liner providing an additional moisture barrier within the thermal liner is provided. The additional moisture barrier extends from an edge of the protective garment, into the protective garment, for at least several inches from the edge. The edge could be the distal edge of an arm sleeve of a protective coat, the lower edge of the protective coat, or the distal edge of a leg sleeve of a pair of protective pants.

6 Claims, 1 Drawing Sheet

PROTECTIVE GARMENT COMPRISING OUTER SHELL, OUTER MOISTURE BARRIER, THERMAL LINER WITHIN OUTER MOISTURE BARRIER, AND INNER MOISTURE BARRIER AT DISTAL EDGES OR AT HEMS

TECHNICAL FIELD OF THE INVENTION

This invention pertains to a protective garment, such as a protective garment for a firefighter or for an emergency worker, of a type comprising an outer shell, a liner providing a moisture barrier within the outer shell, and a thermal liner within the liner providing the moisture barrier, which thus is located between the outer shell and the thermal liner.

BACKGROUND OF THE INVENTION

In a protective garment of the type noted above, it has been known for the liner providing the moisture barrier to be inwardly folded over the thermal liner so as to form a hem, which extends for about one inch and which is sewn to the thermal liner.

When a protective garment of the type noted above becomes wet with water reaching beyond such a hem at the distal edge of an arm of a protective coat, reaching beyond such a hem at the lower edge of a protective coat, or reaching beyond such a hem at the distal edge of a leg of a pair of protective pants, particularly if the thermal liner has a fibrous core, water can be wicked by and through the thermal liner, which can become damp, soggy, and uncomfortable to the wearer of the protective garment.

Heretofore, as an expedient to prevent water from being wicked by and through the thermal liner, it has been known to apply a water-repellant finish, such as a Teflon™ or Scotchguard™ finish, to the inwardly facing surface of the thermal liner. U.S. Pat. No. 6,430,754 B1 discloses a firefighting garment of related interest.

U.S. Pat. No. 4,502,153 discloses an apparel liner of related interest. The apparel liner has a first vapor barrier layer and a second vapor barrier layer, each of substantially moisture impervious material, and a layer of fibrous, thermal insulating material between the first and second vapor barrier layers.

U.S. patent application Ser. No. 10/894,187, which was filed on Jul. 19, 2004, by Alan W. Schierenbeck et al. and the disclosure of which is incorporated herein by reference, discloses a composite structure of related interest.

SUMMARY OF THE INVENTION

As summarized in a first manner, this invention provides a protective garment comprising an outer shell, a liner providing an outer moisture barrier and having an outer surface facing an inner surface of the outer shell, a thermal liner having an outer surface facing an inner surface of the liner providing the outer moisture barrier, and a liner providing an inner moisture barrier and having an outer surface facing an inner surface of the thermal liner, wherein the inner moisture barrier extends from an edge of the protective garment, into the protective garment, for at least several inches from the edge.

As summarized in a second manner, this invention provides in a protective garment comprising an outer shell, a liner providing a conventional moisture barrier within the outer shell, and a thermal liner within the liner providing the conventional moisture barrier, an improvement wherein a liner providing an additional moisture barrier within the thermal liner is provided and wherein the additional moisture barrier extends from an edge of the protective garment, into the protective garment, for at least several inches from the edge.

In a preferred embodiment of this invention, the liner providing the outer moisture barrier and the liner providing the inner moisture barrier are respective portions of a single liner, which is folded at the edge of the protective garment. In an alternative embodiment of this invention, the liner providing the outer moisture barrier and the liner providing the inner moisture barrier are made of similar materials and are affixed to one another, as by being sewn, along the edge of the protective garment.

This invention contemplates that, as contrasted with a water-repellant finish applied to a thermal liner by spraying, rolling, or dipping, the liners providing the respective moisture barriers are self-supporting sheets of a suitable neoprene or other rubber or of a suitable moisture-repellant material, which may be breathable.

DETAILED DESCRIPTION OF THE ILLUSTRATED EMBODIMENTS

Figure 1:
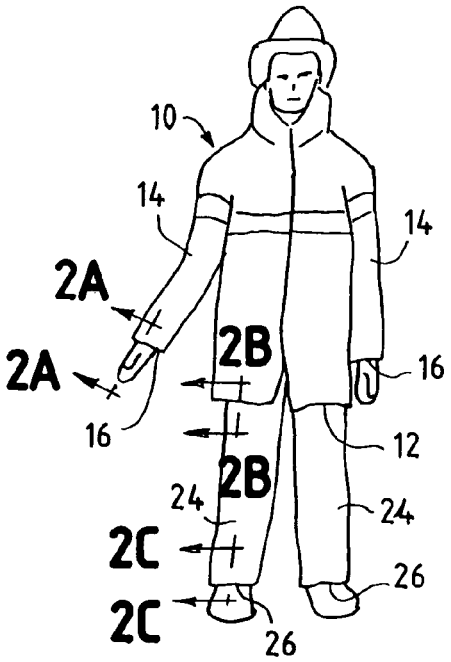
FIG. 1 is a pictorial view of a firefighter wearing protective garments, namely, a protective coat and a pair of protective pants, which garments comprise several examples of a preferred embodiment of this invention.

As illustrated in FIG. 1, a firefighter is wearing an ensemble of protective garments, which include a protective coat 10 having a lower edge 12 and having two arm sleeves 14, each having a distal edge 16, and which include a pair of protective pants 20 having two leg sleeves 24, each having a distal edge 26. The edges 12, 16, 26, are regarded as edges of the protective garment 10, 20.

Figure 2:
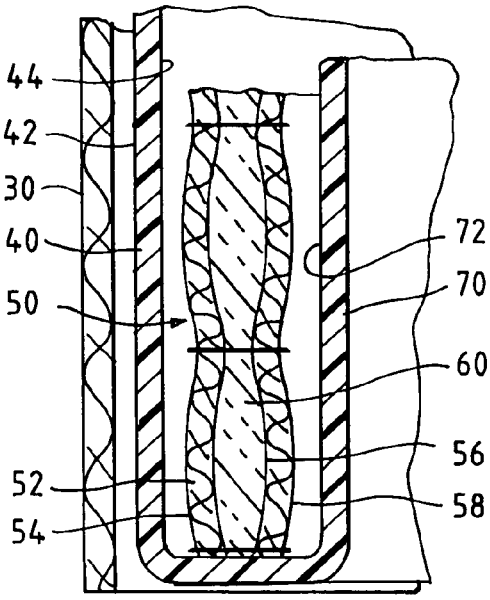
FIG. 2, on an enlarged scale, is a sectional view, which is similar whether taken along any of lines 2A—2A, 2B—2B, and 2C—2C in FIG. 1, in a direction indicated by arrows.

As illustrated in FIG. 2, the lower edge 12 of the protective coat 10, each of the distal edges 16 of the arm sleeves 14, and the distal edges 26 of the leg sleeves 24 has a similar construction comprising an outer shell 30, a liner 40 providing an outer moisture barrier, a thermal liner 50, and, as provided by this invention, a liner 70 providing an inner moisture barrier, which extends from the edge 12, 16, 26 of the protective garment 10, 20, into the protective garment 10, 20, for at least several inches from the edge 12, 16, 26.

The outer shell 30 has an inner surface 32 and is made from a suitable fabric, such as a NomeX™ or Kevlar™ fabric. The liner 40 providing the outer moisture barrier is worn within the outer shell 30, has an outer surface 42 facing the inner surface 32 of the outer shell 30 and an inner surface 44, and is made from a neoprene rubber, as illustrated in FIG. 2, or from a breathable, water-repellant fabric, such as BreatheTex™ fabric. The thermal liner 50, which is worn within the liner 40 providing the outer moisture barrier, has an outer, fabric layer 52 defining an outer surface 54 of the thermal liner 50, an inner, fabric layer 56 defining an inner surface 58 of the thermal liner 50, and a fibrous fill 60 interposed between those layers 52, 56, and is quilted so as to segregate the fibrous fill 60 into discrete regions. The outer surface 54 of the thermal liner 50 faces the inner surface 44 of the liner 40 providing the outer moisture barrier.

As provided by this invention, a liner 70 providing an inner moisture barrier and having an outer surface 72 facing the inner surface 58 of the thermal liner 50 is made from the material(s) of the liner 40 providing the outer moisture barrier. The liner 70 providing the inner moisture barrier is worn within the thermal liner 50 and extends from the edge 12, 16, 26 of the protective garment 10, 20, into the protective garment 10, 20, for at least several inches from the edge 12, 16, 26. Thus, the liner 70 providing the inner moisture barrier protects the thermal liner 50 against becoming wet from water entering the protective garment 10, 20, for at least several inches from the edge 12, 16, 26. However, where the liner 70 does not cover the inner surface 58 of the thermal liner 50, the thermal liner 50, if made from a material capable of wicking water, is able to wick sweat away from a wearer of the protective garment 10, 20.

Figure 3A:
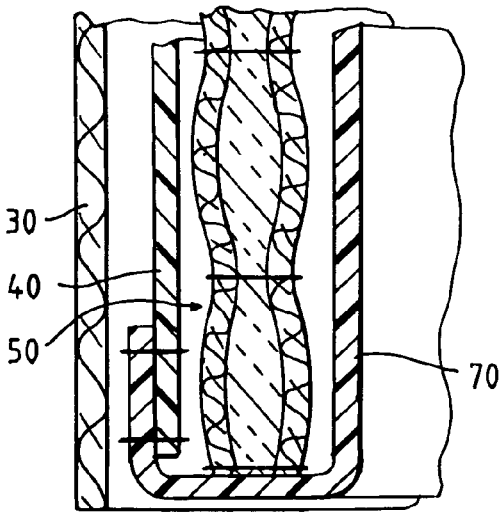
FIGS. 3A and 3B are similar, sectional views, which illustrate alternative embodiments of this invention.
Figure 3B:
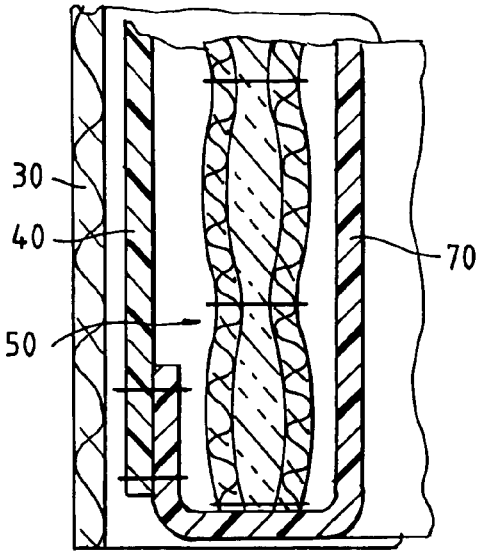

In the preferred embodiment illustrated in FIG. 2, the liner 40 providing the outer moisture barrier and the liner 70 providing the inner moisture barrier are respective portions of a single liner, which is folded over the thermal liner 50 at the edge 12, 16, 26, of the protective garment 10, 20. In the alternative embodiments illustrated in FIGS. 3A and 3B, the liner 40 providing the outer moisture barrier and the liner 70 providing the inner moisture barrier are made of similar materials and are affixed to one another, by being sewn, along the edge 12, 16, 26, of the protective garment 10, 20. As illustrated in FIGS. 3A and 3B, the liner 70 is folded over the thermal liner 50 so as to form a hem 80, which is sewn to the liner 40 outwardly of the outer, fabric layer 56 of the thermal liner 50. The liner 40 could be alternatively folded over the thermal liner 50 so as to form a comparable hem, which would be then sewn to the liner 70 inwardly of the inner, fabric layer 56 of the thermal liner 50.

What is claimed is:

1. A protective garment comprising an outer shell, a liner providing an outer moisture barrier and having an outer surface facing an inner surface of the outer shell, a thermal liner having an outer surface facing an inner surface of the liner providing the outer moisture barrier, and a liner providing an inner moisture barrier and having an outer surface facing an inner surface of the thermal liner, wherein the inner moisture barrier extends from an edge of the protective garment, into the protective garment, for at least several inches from the edge and the inner and outer moisture barriers constitute means for providing a continuous moisture barrier, and wherein the liner providing the outer moisture barrier and the liner providing the inner moisture barrier are respective portions of a single liner, which is folded over the thermal liner at the edge of the protective garment.

2. The protective garment of claim 1, wherein the liner providing the outer moisture barrier and the liner providing the inner moisture barrier are made of similar materials and are affixed to one another, along the edge of the protective garment.

3. The protective garment of claim 1, wherein the liner providing the outer moisture barrier and the liner providing the inner moisture barrier are made of similar materials and are sewn to one another, along the edge of the protective garment.

4. In a protective garment comprising an outer shell, a liner providing a conventional moisture barrier within the outer shell, and a thermal liner within the liner providing the conventional moisture barrier, an improvement wherein a liner providing an additional moisture barrier within the thermal liner is provided and wherein the additional moisture barrier extends from an edge of the protective garment, into the protective garment, for at least several inches from the edge and the inner and outer moisture barriers constitute means for providing a continuous moisture barrier, and wherein the liner providing the outer moisture barrier and the liner providing the inner moisture barrier are respective portions of a single liner, which is folded over the thermal liner at the edge of the protective garment.

5. The improvement of claim 4, wherein the liner providing the outer moisture barrier and the liner providing the inner moisture barrier are made of similar materials and are affixed to one another, along the edge of the protective garment.

6. The improvement of claim 4, wherein the liner providing the outer moisture barrier and the liner providing the inner moisture barrier are made of similar materials and are sewn to one another, along the edge of the protective garment.

* * * * *